US009398670B2

(12) United States Patent
Kidakarn

(10) Patent No.: US 9,398,670 B2
(45) Date of Patent: Jul. 19, 2016

(54) REMOTELY CONTROLLED HOLIDAY LIGHTING AND SOUND SYSTEM

(71) Applicant: Michael Kidakarn, Pasadena, CA (US)

(72) Inventor: Michael Kidakarn, Pasadena, CA (US)

( * ) Notice: Subject to any disclaimer, the term of this patent is extended or adjusted under 35 U.S.C. 154(b) by 0 days.

(21) Appl. No.: 14/789,909

(22) Filed: Jul. 1, 2015

(65) Prior Publication Data

US 2016/0007430 A1 Jan. 7, 2016

Related U.S. Application Data

(60) Provisional application No. 62/020,950, filed on Jul. 3, 2014.

(51) Int. Cl.

| | |
|---|---|
| ***H05B 37/00*** | (2006.01) |
| ***H05B 37/02*** | (2006.01) |
| ***F21V 33/00*** | (2006.01) |
| ***F21V 23/04*** | (2006.01) |
| ***H05B 33/08*** | (2006.01) |
| *F21W 121/04* | (2006.01) |

(52) U.S. Cl.

CPC ..... *H05B 37/0272* (2013.01); *F21S 4/10* (2016.01); *F21V 23/0435* (2013.01); *F21V 33/0056* (2013.01); *H05B 33/086* (2013.01); *H05B 37/029* (2013.01); *F21W 2121/04* (2013.01)

(58) Field of Classification Search

USPC ..... 315/185 R, 185 S, 200 A; 362/565, 654, 362/249.14, 249.16, 249.17, 249.18, 249.19

See application file for complete search history.

(56) References Cited

U.S. PATENT DOCUMENTS

2013/0325892 A1* 12/2013 Edwards ..... G06F 17/30864 707/769

2014/0152181 A1* 6/2014 Burkhart ..... H05B 37/029 315/122

* cited by examiner

*Primary Examiner* — Minh D A

(74) *Attorney, Agent, or Firm* — Elizabeth Yang

(57) ABSTRACT

A remotely controlled holiday lighting and sound system provides a remotely controlled and decorated control module that integrates into a holiday symbol, such as a Christmas tree, to control a holiday themed lighting pattern and audio recording for a plurality of light strings and a speaker. The system provides a plurality of light strings having spaced apart lights connected together in series around the holiday symbol. The system further includes a speaker that integrates into the holiday symbol and emits a holiday themed audio recording that is consistent with the theme of the holiday symbol. A control module is associated with the light strings and the speaker for selective control of each. The control module is covered with a holiday themed ornamental member. A receiver in the control module uses Wi-Fi or Bluetooth protocol to receive command signals from a transmitter in a mobile communication device.

20 Claims, 3 Drawing Sheets

REMOTELY CONTROLLED HOLIDAY LIGHTING AND SOUND SYSTEM

CROSS-REFERENCE TO RELATED APPLICATIONS

This Non-Provisional patent application claims priority from the Provisional Patent Application No. 62/020,950.

FIELD OF THE INVENTION

The present invention relates generally to a remotely controlled holiday lighting and sound system. More so, a holiday lighting and sound system provides a remotely controlled control module that is covered with a holiday themed ornamental member, and is integrated into a holiday symbol to control a holiday themed lighting pattern for a plurality of light strings that join with the holiday symbol, and also to control a holiday themed recording that emits from a speaker that joins with the holiday symbol.

BACKGROUND OF THE INVENTION

Typically, Christmas trees are a common feature of the Christmas holiday season. They are traditionally cut pine trees or fir trees that are supported by a metal or wooden base and are decorated with lights, ornaments and other eye catching accessories. There are also reusable Christmas trees that are comprised of a trunk member and branches that can fold out when in use, but otherwise be folded up for storage. The aesthetic effect and appearance of the Christmas tree is even further enhanced when the lights pulse or vary in intensity. Also, during the Christmas season, users are entertained by listening to Christmas carols while sitting around a Christmas tree.

It is known that, decorative lights are used on buildings for many reasons, the most common of which is probably to celebrate the Christmas season. The decorative lights are typically fixed in color and celebratory purpose. For example, some conventional light strings comprise a plurality of lights that all have the same color (e.g., all white, all red, etc.). Another conventional light string comprises a plurality of lights that are multicolored (e.g., red, green, blue, yellow, white, etc.). Further, some of these light strings are designed to all be lit at the same time, while others are designed to turn on and off intermittently (e.g., flashing or blinking). Many of these lights are suitably colored for a particular holiday, e.g., Christmas, where the lights may be solid red and green.

Typically, strings of lights are commonly used for holiday decoration, for example, for decorating Christmas trees, buildings, and the like. In many instances, such light strings are constructed of straight, plastic coated conductors, with the light fittings connected in either parallel or series fashion. At one end of the light string is a power connector, usually a power plug adapted to connect to a conventional wall power source. Commonly, the other end of the string has a power source for linking an additional light string for extending the light display.

Thus, while the displaying of lights is festive, attractive and very common, it can be a time consuming to put up the lights and then program the lights to pulse or vary in intensity. Further, when audio recordings of Christmas carols are used, synchronizing the lighting pattern and the Christmas carols can be problematic. Another problem is that these functions cannot be performed remotely or with the use of digital technology, so as to increase the options of Christmas carols and lighting patterns.

Other proposals have involved lighting systems for holiday trees. The problem with these devices is that they do not provide remote control of the lights and the speakers, along with the capacity to download lighting patterns and Christmas carols.

Thus, an unaddressed need exists in the industry to address the aforementioned deficiencies and inadequacies. Even though the above cited methods for decorating a Christmas tree meets some of the needs of the market, a remotely controlled control module that is covered with a holiday themed ornamental member, and is integrated into a holiday symbol to control a holiday themed lighting pattern for a plurality of light strings that join with the holiday symbol, and also to control a holiday themed recording that emits from a speaker that joins with the holiday symbol is still desired.

SUMMARY OF THE INVENTION

The present invention is directed to a remotely controlled holiday lighting and sound system that provides a control module that is integrated into a holiday symbol, such as a Christmas tree. The control module is configured to control a holiday themed lighting pattern for a plurality of light strings that join with the holiday symbol. The control module is also configured to control a holiday themed audio recording that emits from a speaker. The speaker integrates into the holiday symbol. The control module, and the speaker may be at least partially covered with a holiday themed ornamental member, so as to visually integrate into the holiday theme of the holiday symbol.

The remotely controlled holiday lighting and sound system, hereafter, "system", provides a plurality of light strings, each light string including a plurality of spaced apart lights connected together in series while overlaying and intertwining through the holiday symbol. The lights illuminate in various colors, patterns, and strobe effect frequency that are consistent with the holiday theme of the holiday symbol. The system further includes a speaker that integrates into the holiday symbol. The speaker emits an audio recording that is consistent with the theme of the holiday symbol. A control module is associated with the light strings and the speaker for selective control of each. In one embodiment, the control module is covered with a holiday themed ornamental member that carries the same them as the holiday symbol. In this manner, the control module is camouflaged, so as to detract from the associated circuitry and electrical components on the holiday symbol.

In one embodiment, the control module includes a receiver having a Wi-Fi or Bluetooth module. The receiver is configured to receive command signals from a mobile communication device. The receiver is adapted for receiving wireless command signal signals from a mobile communication device through the Wi-Fi or Bluetooth wireless technology. The control module comprises electronic circuitry including a microprocessor programmed to receive and decode specific wireless command signal signals that are transmitted to the receiver from the mobile communication device. In response to the command signal signals, the control module operates the circuitry to cause the lights to illuminate in specific defined patterns dictated by the command signal. The control module also operates the circuitry to cause the audio recordings to emit from the speaker. Though in other embodiments, the light patterns and audio recordings may be stored in the microprocessor, and then actuated by the command signal. In one possible embodiment, a lighting pattern and a recording having the same theme of the holiday symbol may be stored in the microprocessor, and later actuated when needed.

The system may utilize a mobile communication device to transmit command signals for actuating the lighting pattern and audio recording. The mobile communication device includes a transmitter to provide the command signal signals. The transmitter is adapted to generate and transmit wireless command signal signals to the receiver in the control module for selectively establishing the specific defined patterns for the light strings. The transmitter utilizes Wi-Fi or Bluetooth technology to transmit the command signal. Similar to the microprocessor, the mobile communication device may store lighting patterns and audio programs that are consistent with the theme of the holiday symbol, and then transmit the programs to the control module for actuation of the lights and speaker.

In some embodiments, the mobile communication device may further include a software application for monitoring the system and controlling the command signals from the mobile communication device. The mobile communication device may include, without limitation, a smart phone, a smartwatch, a tablet, a laptop, a server, a network system, and a computer. In another embodiment, the system further includes a wireless networking module that is configured to enable communication between the mobile communication device and the control module.

One objective of the present invention is to provide a remotely controlled holiday lighting and sound system and a string light device thereof allowing users to wirelessly control a string light thereof and exhibit a desired visual effect through the use of a mobile device.

Another objective is to provide a control module that integrates in to a holiday symbol, such as a Christmas tree, to control a plurality of light strings and a speaker through Wi-Fi or Bluetooth technology.

Another objective is to provide an ornamental member, such as a Christmas tree decoration that covers the control module.

Another objective is to provide a plurality of light strings that overlays the Christmas tree and is operable remotely with a mobile communication device.

Another objective is to provide a speaker that integrates with the control module and emits a recording.

Yet another objective is to provide lighting patterns that are coordinated form the recordings of the speaker.

Yet another objective is to provide a mobile communication device, such as a smart phone, that easily communicates with the control module from inside a home or office.

Yet another objective is to provide a microprocessor that integrates into the control module for storing lighting patterns and recordings that are consistent with the theme of the holiday symbol.

Yet another objective is to provide cost effective lighting system and speaker that enhance the Christmas tree.

Other systems, devices, methods, features, and advantages will be or become apparent to one with skill in the art upon examination of the following drawings and detailed description. It is intended that all such additional systems, methods, features, and advantages be included within this description, be within the scope of the present disclosure, and be protected by the accompanying claims and drawings.

BRIEF DESCRIPTION OF THE DRAWINGS

The invention will now be described, by way of example, with reference to the accompanying drawings, in which.

Like reference numerals refer to like parts throughout the various views of the drawings.

DETAILED DESCRIPTION OF THE INVENTION

Figure 1:
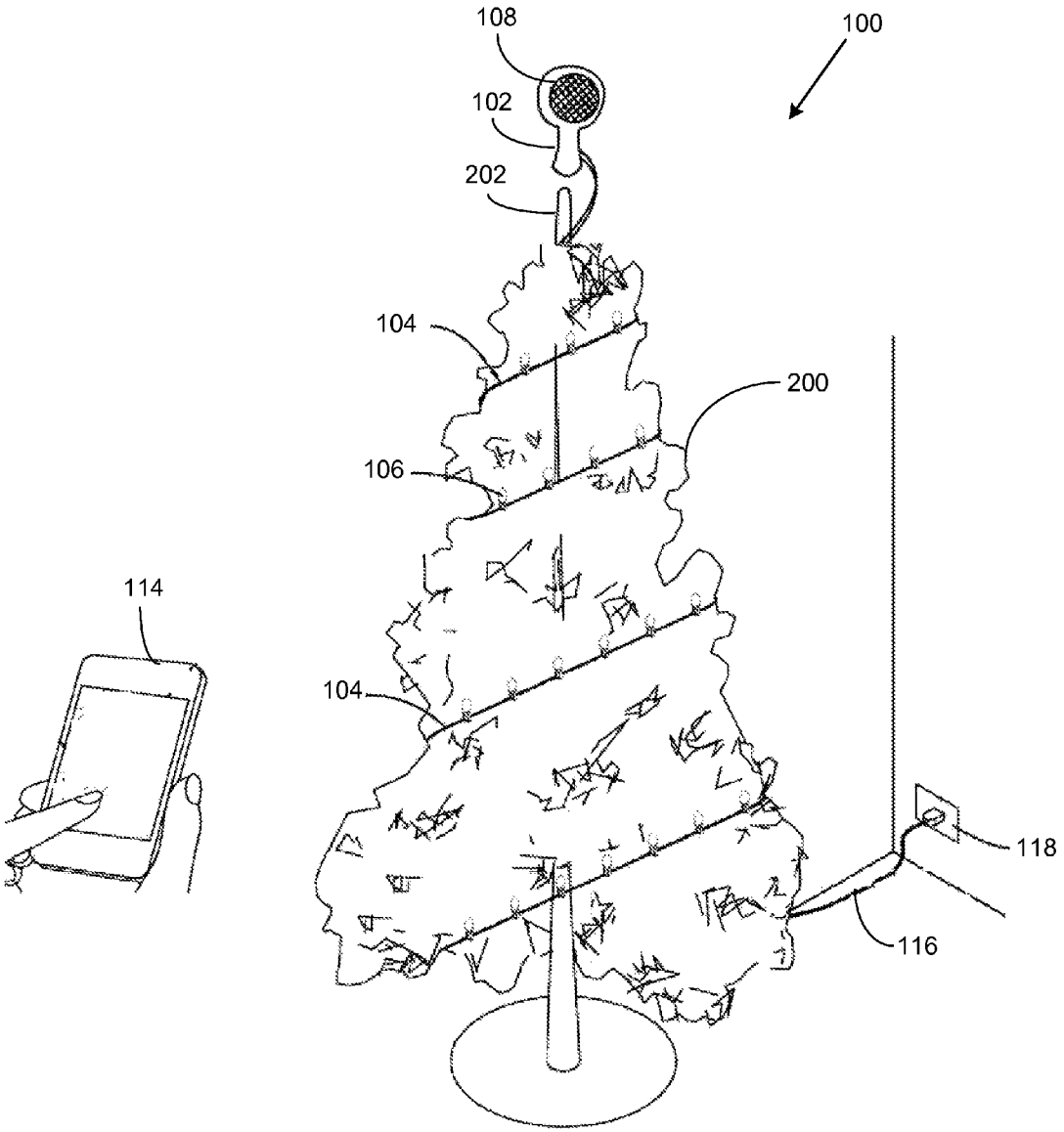
FIG. 1 illustrates a perspective view of an exemplary remotely controlled holiday lighting and sound system including an exemplary mobile communication device controlling lighting patterns and audio recordings, in accordance with an embodiment of the present invention.

The following detailed description is merely exemplary in nature and is not intended to limit the described embodiments or the application and uses of the described embodiments. As used herein, the word "exemplary" or "illustrative" means "serving as an example, instance, or illustration." Any implementation described herein as "exemplary" or "illustrative" is not necessarily to be construed as preferred or advantageous over other implementations. All of the implementations described below are exemplary implementations provided to enable persons skilled in the art to make or use the embodiments of the disclosure and are not intended to limit the scope of the disclosure, which is defined by the claims. For purposes of description herein, the terms "first," "second," "left," "rear," "right," "front," "vertical," "horizontal," and derivatives thereof shall relate to the invention as oriented in FIG. 1. Furthermore, there is no intention to be bound by any expressed or implied theory presented in the preceding technical field, background, brief summary or the following detailed description. It is also to be understood that the specific devices and processes illustrated in the attached drawings, and described in the following specification, are simply exemplary embodiments of the inventive concepts defined in the appended claims. Hence, specific dimensions and other physical characteristics relating to the embodiments disclosed herein are not to be considered as limiting, unless the claims expressly state otherwise.

At the outset, it should be clearly understood that like reference numerals are intended to identify the same structural elements, portions, or surfaces consistently throughout the several drawing figures, as may be further described or explained by the entire written specification of which this detailed description is an integral part. The drawings are intended to be read together with the specification and are to be construed as a portion of the entire "written description" of this invention as required by 35 U.S.C. §112.

Figure 2:
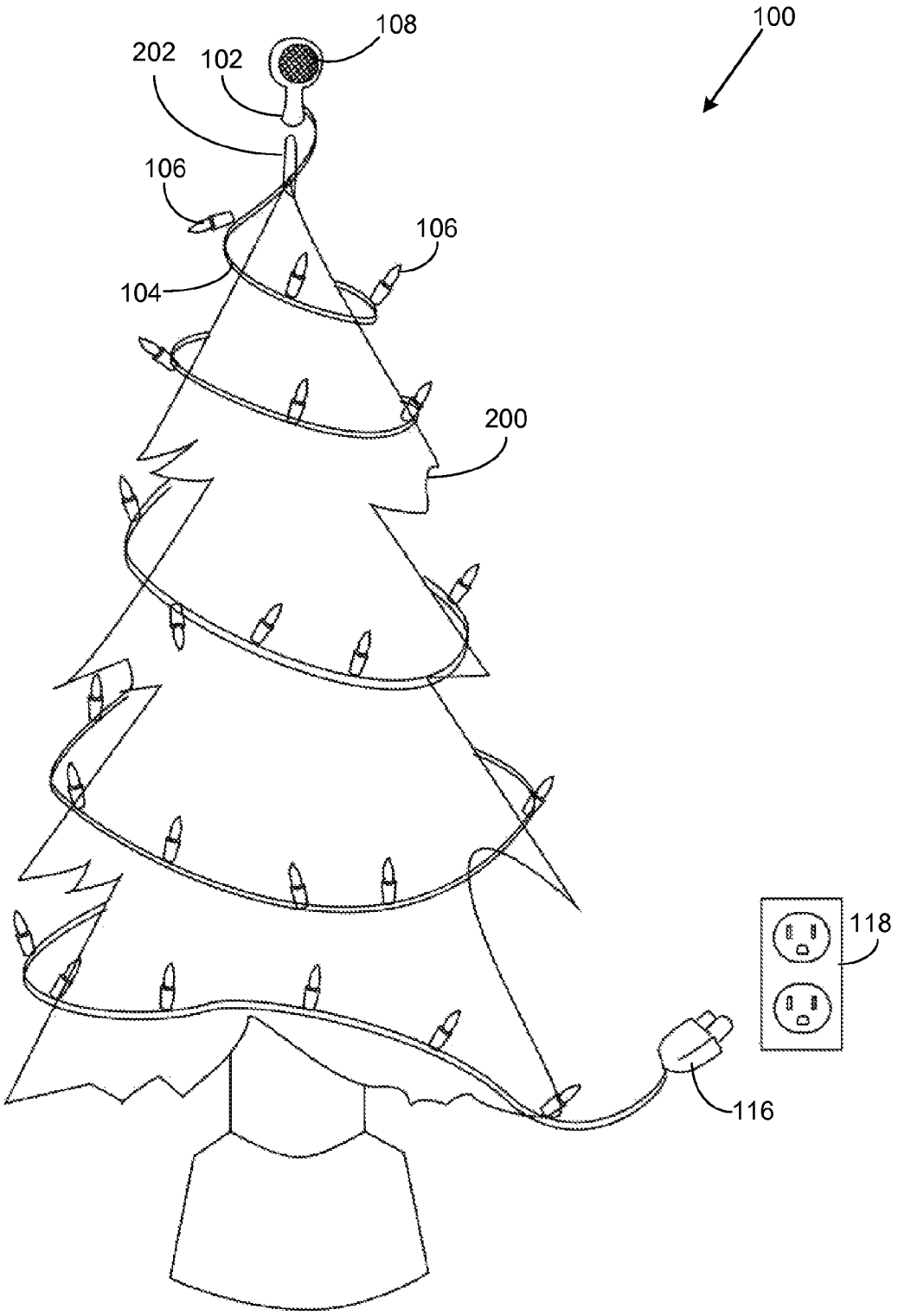
FIG. 2 illustrates a perspective view of the remotely controlled holiday lighting and sound system integrated into a Christmas tree, in accordance with an embodiment of the present invention.
Figure 3:
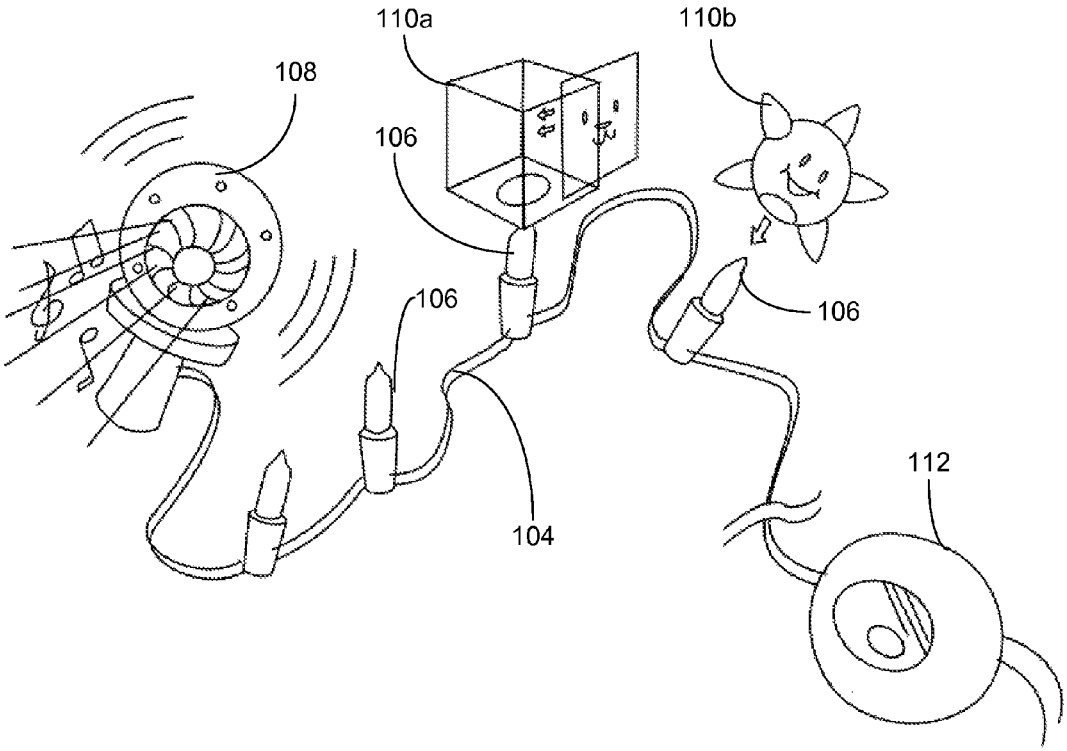
FIG. 3 illustrates a perspective view of an exemplary light string with the lights covered with an ornamental member and a secondary speaker, in accordance with an embodiment of the present invention.

In one embodiment of the present invention, presented in FIGS. 1-3, a remotely controlled holiday lighting and sound system 100 provides a remotely controlled control module 102 that is integrated into a holiday symbol 200. The control module 102 is configured to control a holiday themed lighting pattern for a plurality of light strings 104 that overlay and weave into the holiday symbol 200. The control module 102 is also configured to control a holiday themed audio recording that emits from a speaker 108 in the control module 102. The holiday symbol 200 may include, without limitation, a Christmas tree, a wreath, and a holiday themed figurine.

As illustrated in FIG. 1, the remotely controlled holiday lighting and sound system 100, hereafter, "system 100", provides a plurality of light strings 104. The light strings 104 are disposed to overlay and interweave into the holiday symbol 200, such as between and through the branches of a Christmas tree. In one possible embodiment, the light strings 104 may plug directly into an external power source 118 through a power cord 116. Each light string comprises a plurality of spaced apart lights 106 that are connected together in series around the holiday symbol 200. The lights 106 form a lighting pattern that illuminates in various colors, patterns, and strobe effect frequencies that are consistent with the holiday theme of the holiday symbol 200. In one possible embodiment, the lights 106 may include LEDs having various colors and shapes. The light strings 104 may be appended, i.e., daisy chained together and to the speaker to increase the length and capacity thereof.

Those skilled in the art, in light of the present teachings, will recognize that light displays are known that comprise a plurality of light strings 104, each including a plurality of spaced apart lights 106 connected together in series. It is traditional to string Christmas lights 106 on Christmas trees as a holiday decoration to celebrate Christmas and weave the Christmas lights 106 through the Christmas trees to create festive atmosphere. Any number of light strings 104 may be used.

In some embodiments, the color makeup of the light strings 104 may be varied to create greater festive visual effect. For example, all of the lights 106 of the display may be the same color. Or, each light string may consist of lights 106 of a particular color that is different from the color of the lights 106 of each other string. It is further known to vary the brightness of the lights 106, to cycle the lights 106 on and off, and to fade the lights 106 from a full off to a full on condition in such a manner that the lights 106 appear to be traveling. In one alternative embodiment, any number of light strings 104 may be connected together for decoratively covering the holiday symbol 200.

The system 100 further includes a speaker 108 that integrates into the holiday symbol 200. The speaker 108 emits an audio recording that is consistent with the theme of the holiday symbol 200. In one embodiment, the speaker 108 emits a holiday themed carol, such as "Jingle Bells", or "We Wish You a Merry Christmas". In another embodiment, the speaker 108 may emit a recorded holiday greeting from family members. The audio recording emitted by the speaker 108 may also be synchronized with the lighting pattern.

In one alternative embodiment illustrated in FIG. 3, at least one secondary speaker 112 may replace any one of the lights 106 in the light string. The secondary speaker 112 may include a can that forms a snug fit over the respective light 106. The secondary speaker 112 has the same operative capacity to emit the audio recording as the speaker 108 in the control module 102. This interchangeability of lights 106, speaker 108, and ornamental members 110*a-b* allows the light strings 104 to have both illumination and audible characteristics, which further creates a holiday or festive theme.

Looking back at FIG. 1, the system 100 further comprises a control module 102. The control module 102 is disposed to integrate into the holiday symbol 200. In one embodiment, the control module 102 positions approximately at an apex 202 of the holiday symbol 200. For example, the control module 102 has an open base that receives the top of the Christmas tree. The control module 102 may then be covered with a star or angel figurine. However, in another module, the speaker 108 and a speaker module are cube-shaped to depict a gift, and placed at the foot of the Christmas tree.

The control module 102 is associated with the lights 106 and the speaker 108. The control module 102 is configured to selectively control both the lights 106 and the speaker 108 simultaneously, or separately. The control module 102 may control each string light independently of the others. In other embodiments, the control module 102 may synchronize the speaker 108 and the lights 106.

In some embodiments, the control module 102 may further include a software application for monitoring the system 100 and controlling a command signal from the mobile communication device 114. The software application may be downloadable directly onto the mobile communication device 114. Through the software application, users can select different audio recordings and lighting patterns. Each audio recording and lighting pattern may include a carol, i.e., "Silent Night", and a set of instructions for the lights 106 to follow so that they will be able to synchronize color and pulsing frequency in "dancing" in-sync to the music. For example, if the carol selected is "Silent Night", then the program will play a slow rhythmic show with color and light slowly fading in and out. In contrast, if the program includes the carol "Jingle Bell Rock", the show will have an upbeat presentation of both color and "dancing" light effects with higher light pulsing frequency. In any case, the software application controls the selections and configurations thereof.

Looking now at FIG. 3, the control module 102 is covered with at least one ornamental member 110*a-b* that carries the same theme as the holiday symbol 200. In this manner, the control module 102 is camouflaged, so as to detract from the associated circuitry and electrical components on the holiday symbol 200. The ornamental member 110*a-b* may include, without limitation, a star, an angel figurine, a grafted panel, a sculpted figurine, and a Christmas tree ornament. In one alternative embodiment, the control module 102 illuminates, so as to highlight the ornamental member 110*a-b*.

In one embodiment, the control module 102 includes a receiver having a Wi-Fi or Bluetooth module. The receiver is adapted to receive the command signals from a mobile communication device 114. The receiver is adapted for receiving wireless command signal signals from a mobile communication device 114 through the Wi-Fi or Bluetooth wireless protocol. The control module 102 comprises electronic circuitry including a microprocessor programmed to receive and decode specific wireless command signal that are transmitted to the receiver from the mobile communication device 114. In another embodiment, the system 100 further includes a wireless networking module that is configured to enable communication between the mobile communication device 114 and the control module 102.

In some embodiments, the control module 102 further comprises a memory card. The memory card is preloaded with holiday themed carols. The microprocessor operatively connects to the memory card to control querying and transmission of a selected carol to play through the speaker 108. In another embodiment, the user can remove the included memory card and manually load programs for the system 100 to use. In another embodiment of this invention, the memory card is not included in the control module 102, and instead, the audio recording and lighting pattern is saved on the mobile communication device 114 or a computer. In this embodiment, the audio recording and lighting pattern can be streamed from the mobile communication device 114 through the wireless networking technology.

In response to the command signal, the control module 102 operates the circuitry to cause the lights 106 to illuminate in specific defined patterns dictated by the command signal. The control module 102 also operates the circuitry to cause the audio recordings to emit from the speaker 108. Though in other embodiments, the lighting patterns and audio recordings may be stored in the microprocessor, and then actuated by the command signal. In one possible embodiment, the lighting pattern and the audio recording may be stored in the microprocessor, and later actuated when needed.

The system 100 may utilize a mobile communication device 114 to transmit command signals for actuating the lighting pattern and audio recording. The mobile communication device 114 may include, without limitation, a smart phone, a smartwatch, a tablet, a laptop, a server, a network system 100, and a computer. The mobile communication device 114 includes a transmitter to provide the command signal signals. The transmitter is adapted to generate and transmit wireless command signal signals to the receiver in the control module 102 for selectively establishing the specific defined patterns for the light strings 104. The transmitter utilizes Wi-Fi or Bluetooth technology to transmit the command signal. However in other embodiments, any technologies that enable the lights 106 and the speaker 108 to communicate with the control module 102, and with each, other may be used.

Thus, in operation, the transmitter is programmable to send, the receiver is adapted to receive, and the control module 102 is programmed to use wireless command signals that operate the light strings 104 to provide one, some or all of the following defined patterns: power on and off the lights 106, change the degree of brightness of at least some of the lights 106; cause at least some of the lights 106 to blink; change the lights 106 from brightness to dark at staggered intervals; and alter the strobe frequency of the lights 106. The control module 102 may also actuate the audio recording and adjust volume for the speaker 108.

Similar to the microprocessor, the mobile communication device 114 may also store lighting patterns and audio programs that are consistent with the theme of the holiday symbol 200, and then transmit the programs to the control module 102 for actuation of the lights 106 and speaker 108. In one exemplary embodiment, the mobile communication device 114 is activated to switch to one of the display modes of the string light so as to operate the string light to exhibit a visual effect, such as blinking the string light according to rhythms of music or sounds or changing the luminance or color or the string light. In another exemplary embodiment, the mobile communication device 114 may download a Christmas carol, and then transmit the Christmas carol to the control module 102, such that the Christmas carol emits from the speaker 108.

In conclusion, through a software application on the mobile communication device 114 that enables control and connectivity of the light strings 104 and speaker 108, users may operate the light strings 104 with the mobile communication device 114 to perform different functions, such as blinking the light strings 104 according to rhythm of music or sounds, or changing the luminance or color of the light strings 104. Further, the control module 102 and the speaker 108 may be at least partially covered with at least one ornamental member 110*a-b* having a holiday theme, so as to visually integrate the control module 102 and the speaker 108 into the holiday symbol 200.

Since many modifications, variations, and changes in detail can be made to the described preferred embodiments of the invention, it is intended that all matters in the foregoing description and shown in the accompanying drawings be interpreted as illustrative and not in a limiting sense. Thus, the scope of the invention should be determined by the appended claims and their legal equivalence.

What I claim is:

1. A remotely controlled holiday lighting and sound system for remotely controlling a plurality of light strings and a speaker that are integrated into a holiday symbol, the system comprising:

a control module, the control module defined by a microprocessor and a receiver, the microprocessor configured to store a lighting pattern and an audio recording, the receiver configured to receive a command signal, the command signal operable to actuate the lighting pattern and the audio recording;

at least one ornamental member, the at least one ornamental member configured to at least partially cover the control module;

a plurality of light strings, the plurality of light strings defined by a plurality of lights connected together in spaced-apart series, the plurality of lights configured to operatively connect to the control module, the plurality of lights further configured to illuminate the lighting pattern;

a speaker, the speaker configured to operatively connect to the control module, the speaker further configured to emit the audio recording; and a mobile communication device, the mobile communication device defined by a transmitter and a software application, the transmitter configured to emit the command signal to the receiver in the control module, the software application configured to monitor the system and control the command signal from the mobile communication device.

2. The system of claim 1, wherein the control module is configured to integrate into a holiday symbol.

3. The system of claim 2, wherein the holiday symbol is a Christmas tree.

4. The system of claim 3, wherein the control module is disposed to position approximately at an apex of the Christmas tree.

5. The system of claim 4, wherein the at least one ornamental member includes at least one member selected from the group consisting of: a star, an angel figurine, a grafted panel, a sculpted figurine, and a Christmas tree ornament.

6. The system of claim 5, wherein the control module illuminates.

7. The system of claim 6, wherein the receiver and the transmitter communicate through a short distance wireless technology.

8. The system of claim 7, wherein the short distance wireless technology is Wi-Fi or Bluetooth.

9. The system of claim 8, further including a wireless networking module.

10. The system of claim 9, wherein the wireless networking module is configured to enable communication between the mobile communication device and the control module.

11. The system of claim 10, wherein the plurality of light strings operatively connect to the Christmas tree through a cable.

12. The system of claim 11, wherein the light strings and the speaker are daisy chained together for increasing the length.

13. The system of claim 12, further including at least one secondary speaker, the at least one secondary speaker configured to replace at least one of the plurality of lights.

14. The system of claim 13, wherein the plurality of lights are at least partially covered by the at least one ornamental member.

15. The system of claim 14, wherein the lighting pattern includes at least one member selected from the group consisting of: color, flashing, and strobe effect frequency.

16. The system of claim 15, wherein the speaker operatively connect to the Christmas tree through a cable.

17. The system of claim 16, wherein the audio recording is Christmas themed music.

18. The system of claim 17, wherein the mobile communication device includes at least one member selected from the group consisting of: a smart phone, a smart watch, a tablet, a server, and a computer.

19. The system of claim 18, wherein the mobile communication device is configured to store the lighting pattern and the audio recording.

20. A remotely controlled holiday lighting and sound system for remotely controlling a plurality of light strings and a speaker that are integrated into a holiday symbol, the system comprising:

a control module, the control module defined by a microprocessor and a receiver, the microprocessor configured to store a Christmas themed lighting pattern and a Christmas themed audio recording, the receiver configured to receive a command signal, the command signal operable to actuate the Christmas themed lighting pattern and the Christmas themed audio recording, the control module configured to illuminate;

at least one Christmas themed ornamental member, the at least one Christmas themed ornamental member configured to at least partially cover the control module;

a plurality of light strings, the plurality of light strings defined by a plurality of lights connected together in spaced-apart series, the plurality of lights configured to operatively connect to the control module, the plurality of lights further configured to illuminate the Christmas themed lighting pattern;

a speaker, the speaker configured to operatively connect to the control module, the speaker further configured to emit the Christmas themed audio recording;

at least one secondary speaker, the at least one secondary speaker configured to replace any one of the plurality of lights, the at least one secondary speaker configured to emit the Christmas themed audio recording;

a smart phone, the smart phone defined by a transmitter and a software application, the transmitter configured to emit the command signal to the receiver in the control module, the software application configured to monitor the system and control the command signal from the smart phone; and a wireless networking module, the wireless networking module configured to enable communication between the control module and the smart phone.

* * * * *